US008701325B1

(12) United States Patent
Rayner

(10) Patent No.: US 8,701,325 B1
(45) Date of Patent: Apr. 22, 2014

(54) DUPLEX WEAPON SYSTEM

(71) Applicant: William V. S. Rayner, Tallahassee, FL (US)

(72) Inventor: William V. S. Rayner, Tallahassee, FL (US)

( * ) Notice: Subject to any disclaimer, the term of this patent is extended or adjusted under 35 U.S.C. 154(b) by 0 days.

(21) Appl. No.: 13/657,014

(22) Filed: Oct. 22, 2012

(51) Int. Cl.
*F41A 21/00* (2006.01)

(52) U.S. Cl.
USPC ..... 42/76.01; 42/77; 42/105; 42/1.08

(58) Field of Classification Search
USPC ..... 42/76.01, 77, 105, 1.08; 102/502
See application file for complete search history.

(56) References Cited

U.S. PATENT DOCUMENTS

| | | | | |
|---|---|---|---|---|
| 3,620,162 | A * | 11/1971 | King | 102/485 |
| 5,221,809 | A | 6/1993 | Cuadros | |
| 6,142,056 | A | 11/2000 | Taleyarkhan | |
| 6,213,024 | B1 | 4/2001 | Jasper, Jr. | |
| 6,223,658 | B1 | 5/2001 | Rosa | |
| 6,283,037 | B1 | 9/2001 | Sclafani | |
| 6,302,028 | B1 | 10/2001 | Guillot-Ulmann | |
| 6,343,431 | B1 * | 2/2002 | Brunn | 42/105 |
| 6,523,478 | B1 * | 2/2003 | Gonzalez et al. | 102/485 |
| 6,655,294 | B1 | 12/2003 | Kerr | |
| 6,722,283 | B1 | 4/2004 | Dindl | |
| 6,820,560 | B1 | 11/2004 | Romppanen | |
| 6,862,995 | B2 | 3/2005 | Kerr | |
| 2005/0188887 | A1 * | 9/2005 | Chang | 102/502 |

* cited by examiner

*Primary Examiner* — J. Woodow Eldred
(74) *Attorney, Agent, or Firm* — J. Wiley Horton

(57) ABSTRACT

A duplex weapon system that is capable of firing a high-mass/low-velocity ("HMLV") projectile followed by a conventional projectile such as a bullet. A barrel adapter is aligned with the bore of the barrel of a conventional firearm. The barrel adapter includes an adapter bore running completely through its length, with the adapter bore terminating in an exit in the forward portion of the barrel adapter. The HMLV projectile is slidably attached to the exterior of the barrel adapter. The HMLV projectile includes a launch tube that covers the exit of the barrel adapter. When a first cartridge is fired b the firearm, expanding propellant gas rushes down the adapter bore and out the exit The expanding gas forces the launch tube and the attached HMLV projectile away from the barrel adapter. The HMLV projectile then flies toward a target.

16 Claims, 13 Drawing Sheets

DUPLEX WEAPON SYSTEM

BACKGROUND OF THE INVENTION

1. Field of the Invention

This invention relates to the field of weapons. More specifically, the invention comprises a duplex weapon system having the ability to initially fire a non-lethal projectile and then a lethal projectile.

2. Description of the Related Art

Small arms such as pistols, rifles, and shotguns have been used by law enforcement and military personnel for well over a century. These traditional weapons inflict potentially life threatening injuries when they are used. While they are highly effective, they present the law enforcement officer with an "all or nothing" decision. If the officer uses a sidearm, for example, serious injury or death will likely result. In many circumstances the officer is facing a belligerent suspect that needs to be subdued. However, the suspect may not present an immediate threat to the safety of the officer or others. In this situation, a less forceful approach is desirable.

Many "non-lethal" alternatives have been developed in recent years. One example is the use of conventional center-fire small arms cartridges employing rubber bullets. These projectiles cause a painful impact that will often deter a subject, but they are unlikely to kill the subject.

Shotgun-fired "bean bags" are another non-lethal option. These projectiles contain a relatively high mass in a soft container. They are generally incapable of penetration, and instead deliver a sharp impulse to a suspect's body. The idea is to take the suspect off his feet.

The latest widespread non-lethal alternative is the TASER eletroshock weapon marketed by TASER International, Inc. of Scottsdale, Arizona, U.S.A. The TASER weapon fires a pair of darts that penetrate a suspect's skin. Each dart is connected back to the handheld firing unit by a trailing wire. The firing unit sends pulses of high-voltage electricity through the two wires. An electrical current is then forced to flow through the suspect's body, thereby causing temporary incapacitation.

The TASER is quite effective in its intended role. However, it also includes a significant drawback: The TASER is strictly non-lethal. If a subject is hit by the TASER and then continues an assault on the officer, the officer must abandon the TASER and quickly switch to a conventional sidearm. And, because the TASER firing unit physically resembles a conventional sidearm, confusion can occur.

Police officers are trained in the handling of sidearms and TASERs, and this training is intended in part to ensure that the officer draws the correct weapon. For a right-handed officer, the sidearm is conventionally carried on the right hip. The TASER is then carried in a supplemental holster on the left hip. The officer undergoes repeated firing training so that he or she instinctively grabs the correct device. However, even with such training, errors have occurred. Under the adrenaline rush of actual combat, officers have pulled the sidearm and fired in the mistaken belief that they were deploying the TASER.

It would therefore be preferable to provide a single weapon that can deliver non-lethal and lethal projectiles. It would also be desirable to provide a single weapon that transitions from the non-lethal projectiles. It would also be desirable to provide a single weapon that transitions from the non-lethal to the lethal mode automatically. The present invention provides such a weapon.

BRIEF SUMMARY OF THE PRESENT INVENTION

The present invention comprises a duplex weapon system that is capable of firing a high-mass/low-velocity ("HMLV") projectile followed by a conventional projectile such as a bullet. A barrel adapter is aligned with the bore of the barrel of a conventional firearm. The barrel adapter includes an adapter bore running completely through its length, with the adapter bore terminating in an exit in the forward portion of the barrel adapter.

The HMLV projectile is slidably attached to the exterior of the barrel adapter. The HMLV projectile includes a launch tube that covers the exit of the barrel adapter. When a first cartridge is fixed by the firearm, expanding propellant gas rushes down the adapter bore and out the exit of the barrel adapter. The expanding gas forces the launch tube and the attached HMLV projectile away from the barrel adapter. The HMLV projectile than flies toward a target. The firearm cycles normally and the next cartridge is loaded in the firing chamber. If the user then fires the weapon again, a conventional bullet is sent down the barrel bore and toward the target.

The HMLV projectile provides a non-lethal impact force that takes a subject off his feet. If the subject is at that point subdued, the officer need take no further action. However, if the subject regains his feet and advances toward the officer, then the next pull of the weapon's trigger delivers a lethal projectile.

REFERENCE NUMERALS IN THE DRAWINGS

Figure 1:
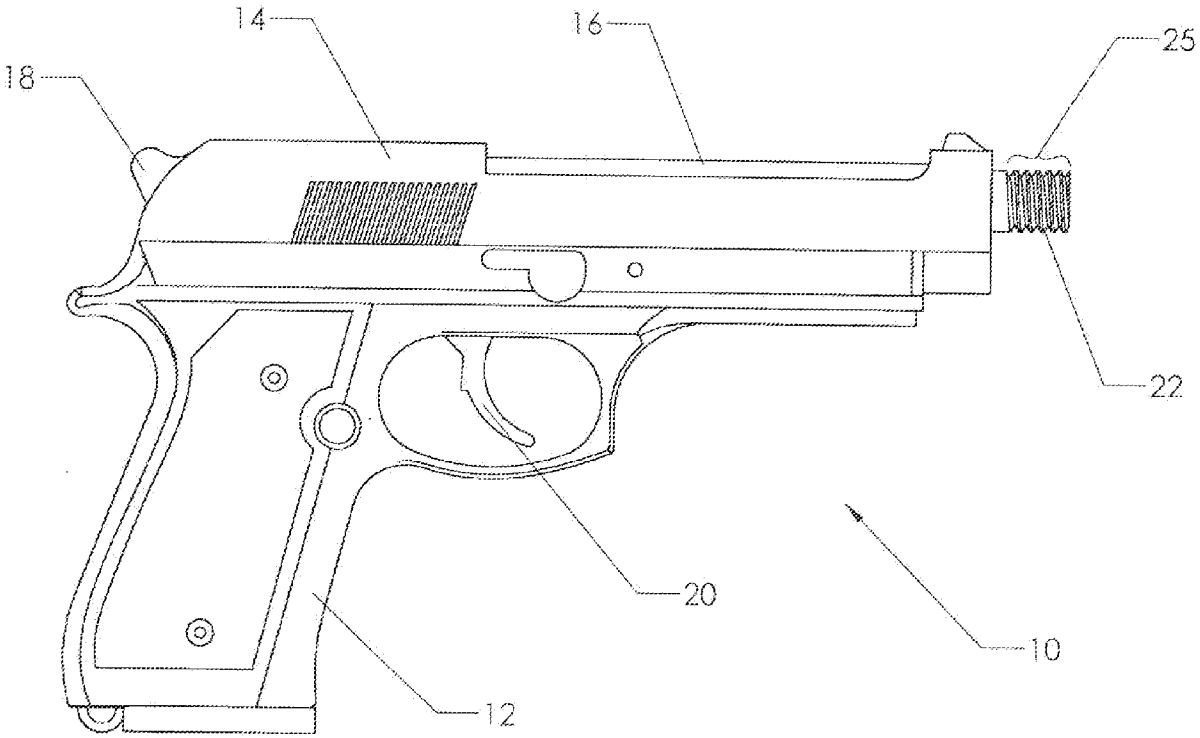
FIG.1 (PRIOR ART)
FIG. 1 is an elevation view, showing a prior art pistol.

| | | | |
|---|---|---|---|
| 10 | pistol | 12 | frame |
| 14 | slide | 16 | barrel |
| 18 | hammer | 20 | trigger |
| 22 | barrel extension | 24 | barrel adapter |

-continued

REFERENCE NUMERALS IN THE DRAWINGS

| | | | |
|---|---|---|---|
| 25 | male thread | 26 | cylinder |
| 28 | nose | 30 | bore |
| 32 | rearward O-ring | 34 | forward O-ring |
| 36 | rearward end | 38 | barrel receiver |
| 39 | external surface | 40 | firearm bore |
| 42 | adapter bore | 44 | exit |
| 46 | central axis | 48 | projectile |
| 50 | launch tube | 51 | internal surface |
| 52 | flange | 54 | nose |
| 56 | tail | 58 | duplex weapon |
| 60 | grip | 62 | shoulder stock |
| 64 | connector | 66 | recoil pad |
| 68 | elastic beam | 70 | elastic beam |
| 71 | bullet trap | 72 | body |
| 73 | bulkhead | 74 | nose |
| 76 | cavity | 78 | backing plate |
| 80 | port | 82 | port cover |
| 84 | frangible bag | 86 | chemical agent |
| 88 | magazine | 90 | blank cartridge |
| 92 | conventional cartridge | 94 | bullet |
| 96 | spent casing | 98 | crush zone |
| 100 | target surface | 102 | projectile |
| 104 | striker | 106 | ejector charge |
| 108 | flash/bang | 110 | battery |
| 112 | base | 114 | hatch |
| 118 | stun controller | 120 | positive lead |
| 122 | negative lead | 124 | launch tube |
| 126 | launch tube | 128 | positive dart |
| 130 | negative dart | 132 | launching charge |
| 134 | laser sight | | |

DETAILED DESCRIPTION OF THE INVENTION

FIG. 1 shows a prior art firearm—pistol 10. This particular example is a semi-automatic pistol capable of holding 13 cartridges in a detachable magazine. The magazine slides into frame 12. Barrel 16 is mounted within slide 14. The pistol is fired by pressing trigger 20. The slide cycles to the rear—along the top frame 12—each time the pistol is fired. This cycling cocks hammer 18 and feeds a fresh cartridge from the magazine into the open breech of barrel 16.

Barrel extension 22 is preferably provided to facilitate the mounting of components needed in the present invention. Male thread 25 may be provided on the exterior of the barrel extension.

The prior art pistol shown fires the well known 9 mm Parabellum cartridge. The 9 mm bullet contained in the cartridge is an exemplary low-mass/high-velocity projectile. The muzzle velocity for the 9 mm Parabellum is generally in the range of 900 feet per second ("fps") to 1300 fps (274 to 396 m/s), The bullet mass is about 0.016 pounds (0.007 Kg). The bullet diameter is 0.355 inches (9.02 mm).

The 9 mm bullet easily penetrates the human body and often causes extensive damage. While not all 9 mm bullet wounds are fatal, a wound to any significant portion of the body has the potential to be fatal. Thus, an officer firing a handgun such as illustrated in FIG. 1 has clearly made the decision to apply "deadly force."

Despite these facts, a bullet that strikes the human body in a Location other than the central nervous system is not likely to be immediately fatal. For example, a wound through the lungs or abdomen may take one or more hours to actually kill. While the gunshot victim will likely experience considerable pain, he may not be incapacitated. Many gunshot victims do fall to the ground, but this is thought to be the result of the victim's knowledge that the wound can be fatal and his desire to minimize Further injury. A gunshot victim who does not possess this knowledge—or a person in a deranged mental state—may not react this way at all.

The. U.S. Army became aware of this problem during the Moro Insurrection of the early 20th Century (know sometimes referred to as the Philippine-American War). During this conflict the standard U.S. Army sidearm chambered the 0.38 Long Colt cartridge. Several Moro warriors were shot through the chest with this weapon, yet continued forward and killed the soldier firing the weapon. The wounds to the Moro warrior were invariably fatal, but the failure of the 0.38 Long Colt to quickly disable the warrior was correctly perceived as a problem.

In studying this situation, the U.S. Army concluded that the Moro warriors had no knowledge of the effect of a gunshot wound and —since they were still physically able to press the attack for a few more seconds—they did so. The result was the U.S. Army's adoption of a higher mass projectile.

Modern law enforcement officers do not encounter Moro warriors. However, they sometimes face a similar hazard when dealing with a subject who is not in control of his own mental state. Drug addiction and severe mental illness sometimes produce a similar disregard for the effect of a gunshot wound.

The solution to these problems is to provide a weapon having the ability to knock a subject off his feet. Such weapons generally fire a high-mass/low velocity projectile. While there is no standard definition of such a projectile, a mass that is greater than 0.15 pounds (0.07 Kg) and a velocity in the range of 30 fps to about 500 fps (12-152 m/s) may generally be considered a high-mass/low-velocity projectile. Such a weapon fires a large and preferably blunt projectile. This strikes the individual—preferably in the torso—and the transfer of momentum takes the individual to the ground.

High-mass/low-velocity weapons are an attractive alternative to the use of a pistol such as that shown in FIG. 1. However, the prior art high-mass/low/velocity weapons are an entirely separate weapon system. An officer must carry and fire this weapon. If the suspect then gets back to his feet and continues the assault, the officer must rapidly switch to a conventional "deadly force" weapon. High-mass/low-velocity weapons have a limited range—typically 20 to 50 feet. Thus, if the suspect resumes the assault, the officer will have very little time to switch to a conventional firearm. The present invention solves this problem by providing a single weapon that is capable of firing both types of projectiles.

Figure 2:
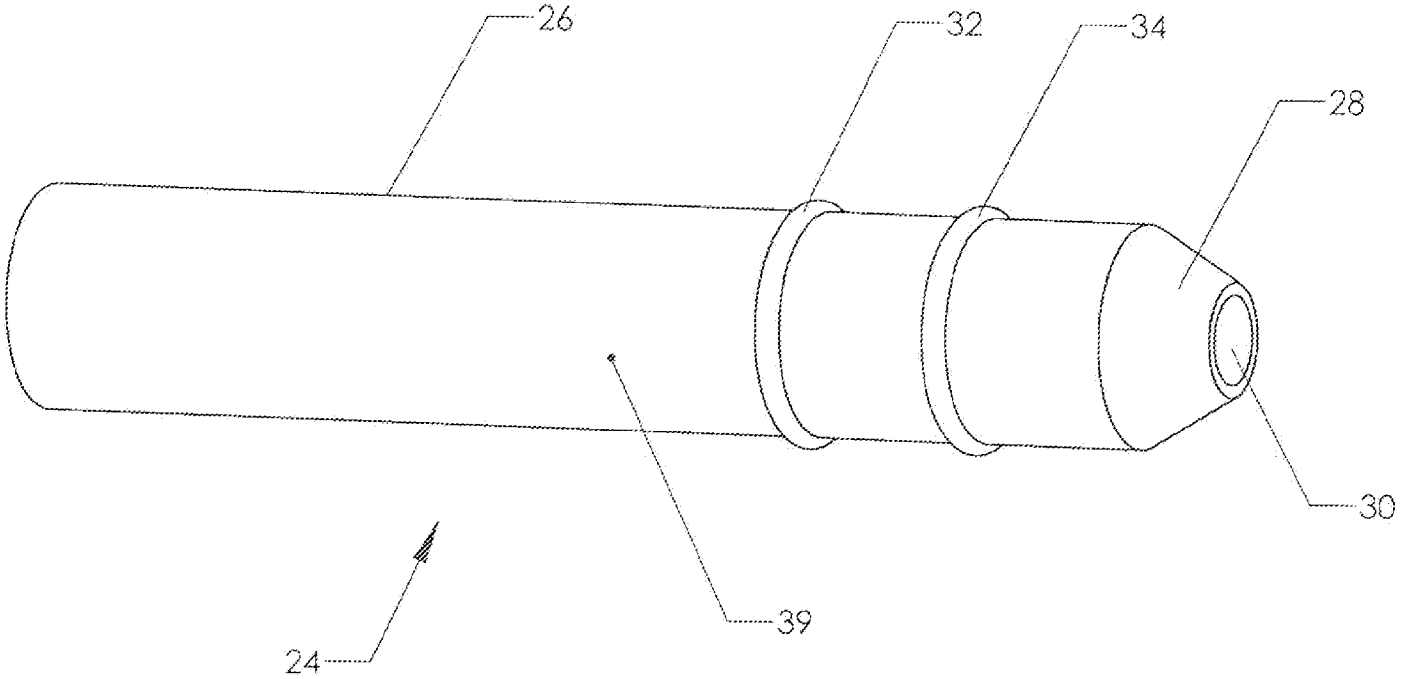
FIG. 2 is a perspective view, showing a barrel adapter used in the present invention.

The invention has two main components—a barrel adapter that attaches to the prior art firearm and a specialized high-mass/low-velocity projectile. FIGS. 2-5 show the barrel adapter and its connection to a firearm. FIG. 2 provides a perspective view of barrel adapter and its connection to a firearm. FIG. 2 provides a perspective view of barrel adapter 24, looking from the forward end toward the rearward end. The reader will observe that barrel adapter 24 includes cylinder 26 and a frusto-conical nose 28. Bore 30 passes through the adapter In this example the external surface of the barrel adapter assumes the shape of a cylinder, but this need not always be the case. The external surface could be square, triangular, or any suitable shape that provides a sliding fit with the projectile. However, as those skilled in the art will know, cylindrical surfaces are particularly easy to fabricate and this therefore represents the preferred embodiment.

One or more sealing components are preferably provided on the exterior surface. In the embodiment of FIG. 2, rearward O-ring 32 and forward O-ring 34 are the sealing components. These O-rings are made of compressible material.

Figure 3:
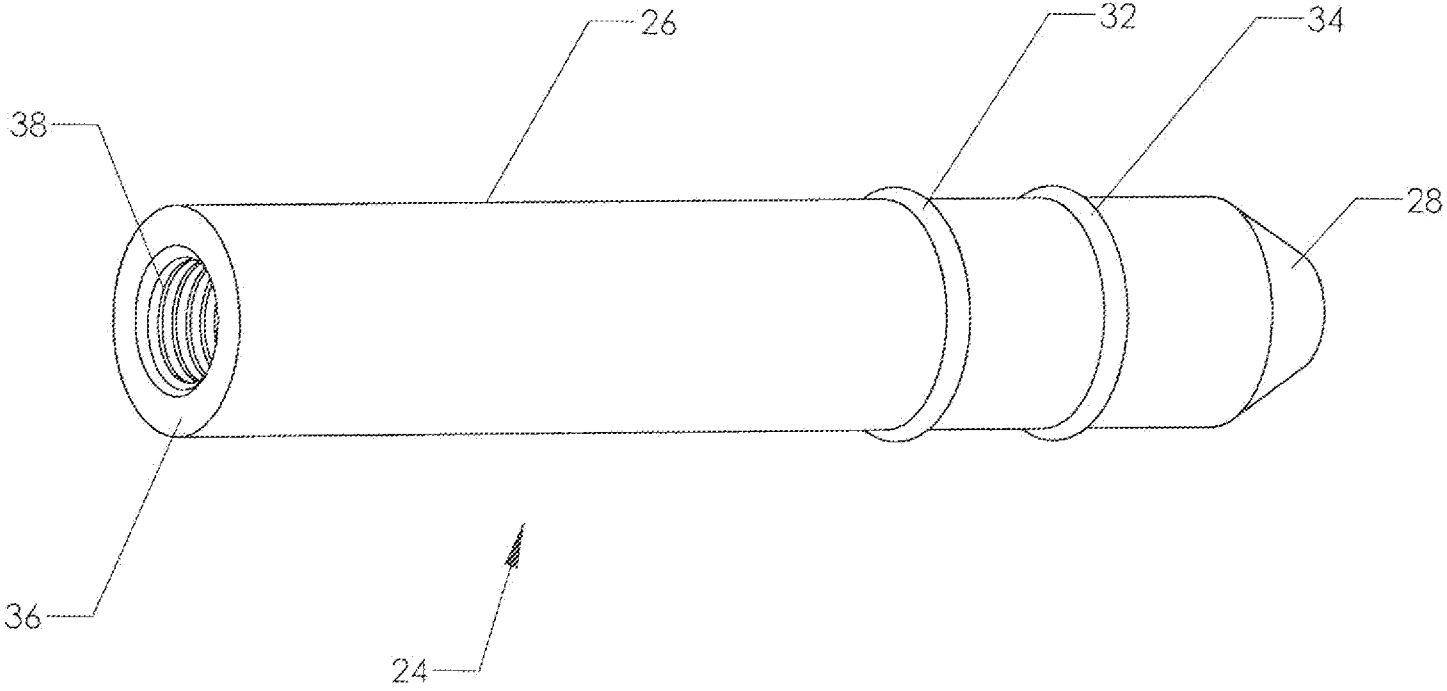
FIG. 3 is a perspective view, showing the barrel adapter of FIG. 2 from a different vantage point.

FIG. 3 shows barrel adapter 24 from a different vantage point—looking from the rearward end toward the forward end. Rearward end 36 opens into barrel receiver 38. The barrel receiver is configured to connect to the muzzle of the barrel of the conventional firearm. This connection could be made in many ways—including a press fit, soldering, etc. In the embodiment shown, a female thread is provided in barrel receiver 38. This female thread is sized to thread onto a male thread provided on the firearm barrel.

The barrel adapter may be made of any suitable material and no particular material is crucial to the invention. As a first example, the barrel adapter may be made of aluminum. As a second example, the barrel adapter may be made of carbon fiber. As a third example, the barrel adapter may be made using a steel "liner" wrapped in composite material.

Figure 4:
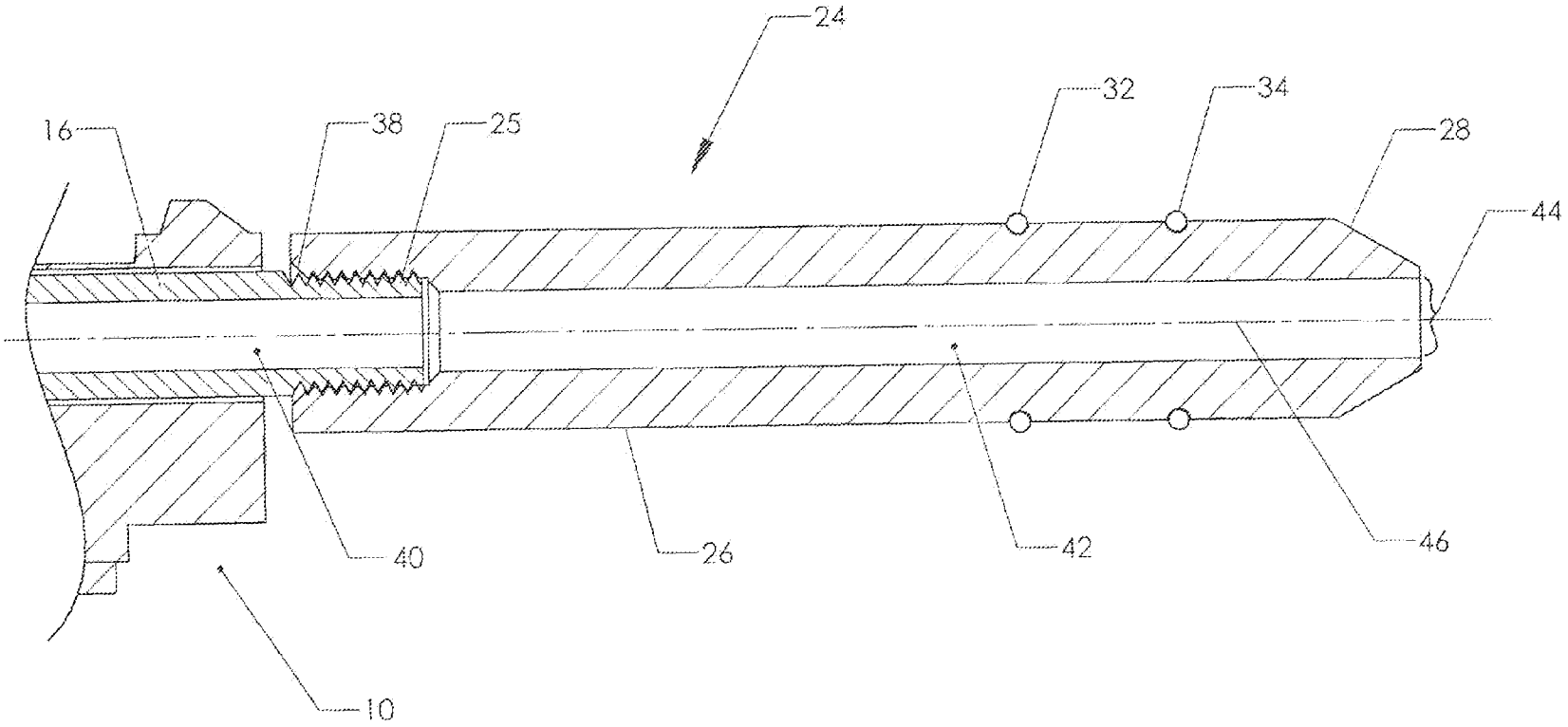
FIG. 4 is a sectional elevation view, showing the barrel adapter attached to a barrel of a prior art pistol.

FIG. 4 shows a sectional elevation view of pistol 10 and barrel adapter 24 installed on barrel 16. The barrel adapter is designed to allow the conventional use of the firearm. That is, the firearm is still able to fire a bullet through the adapter in a manner that is known for prior art sound suppressors.

Firearm bore 40 has a central axis 46. Barrel adapter 24 includes adapter bore 42 that is aligned with central axis 46. This configuration ensures that a bullet exiting firearm bore 40 will travel safely through adapter bore 42 and out exit 44. It is preferable to make adapter bore 42 somewhat larger than firearm bore 40 in order to ensure adequate clearance for the bullet.

The reader will observe how the female thread in barrel receiver 38 threads onto male thread 25 on barrel 16. This threaded engagement ensures the desired alignment between firearm bore 40 and adapter bore 42.

Figure 5:
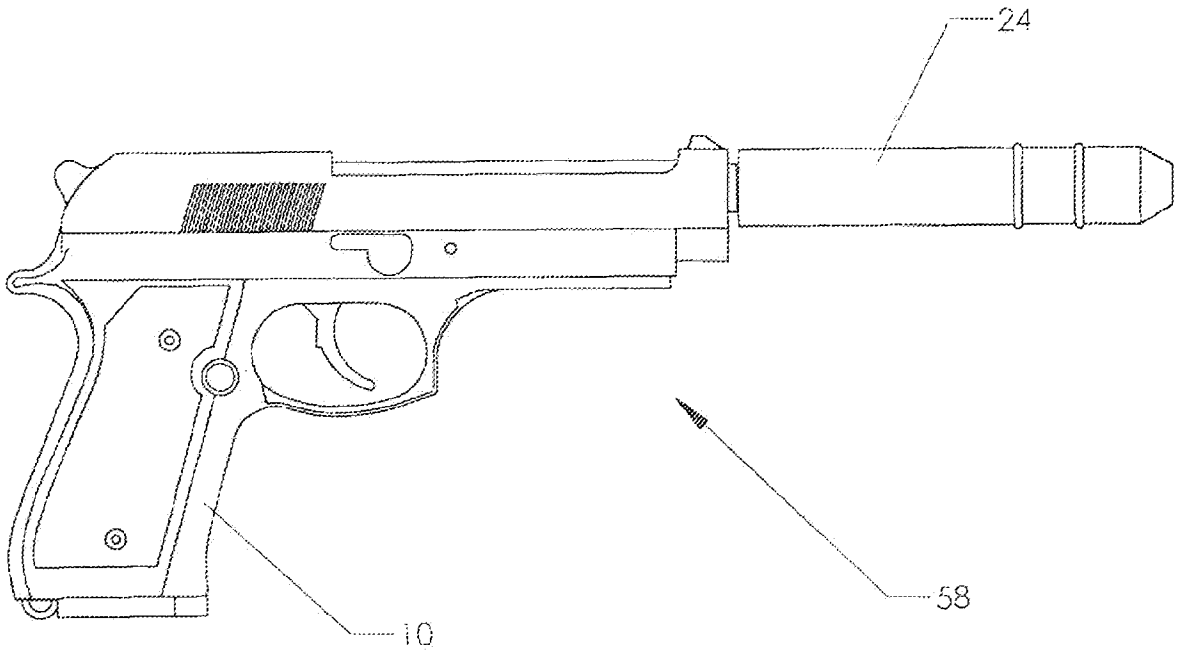
FIG. 5 is an elevation view, showing the barrel adapter attached to a barrel of a prior an pistol.

FIG. 5 shows an elevation view of barrel adapter 24 installed on prior art pistol 10. The combination is referred to as duplex weapon 58. The word "duplex" is used because the weapon is capable of firing two completely different types of projectiles. The weapon can fire a conventional bullet (a low-mass/high-velocity projectile) as well as a high-mass/low-velocity projectile.

Figure 6:
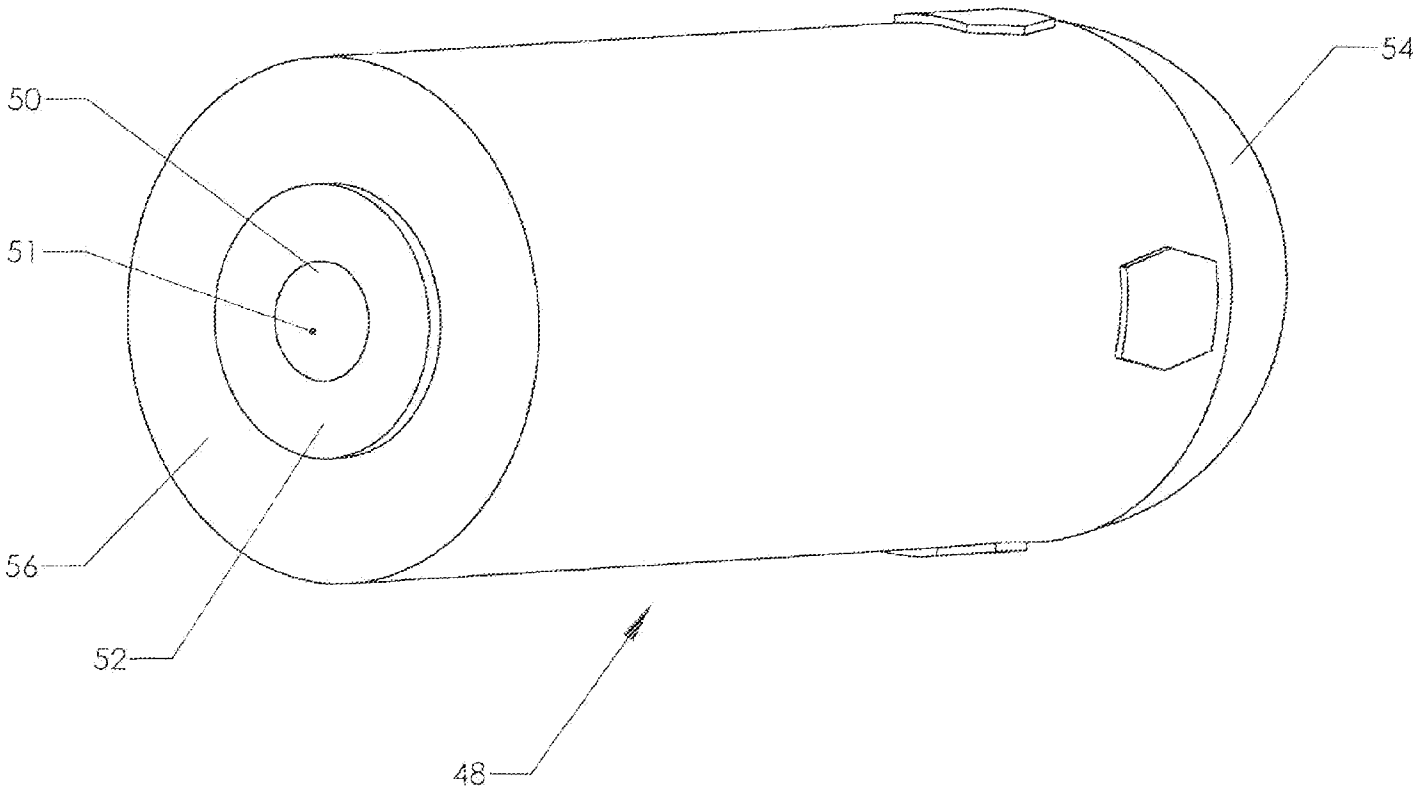
FIG. 6 is a perspective view, showing a projectile used in the present invention.

FIGS. 6-7, 9, and 11-13 illustrate several embodiments of high-mass/low-velocity projectiles suitable for use in the present invention. FIG. 6 shows projectile 48. It includes nose 54 and tail 56. The projectile's exterior surface may be any suitable shape. However, a cylindrical shape (as shown) is preferred. The projectile includes launch tube 50 extending through its interior. The launch tube preferably incorporates a flange 52 covering a portion of tail 56. The launch tube shown in FIG. 6 incorporates a cylindrical interior surface 51 which is sized to be a sliding fit over exterior surface 39 of barrel receiver 24. The interior surface may be any suitable shape that provides a sliding fit over the barrel receiver, and the invention is by no means limited to cylindrical interior surfaces.

Figure 7:
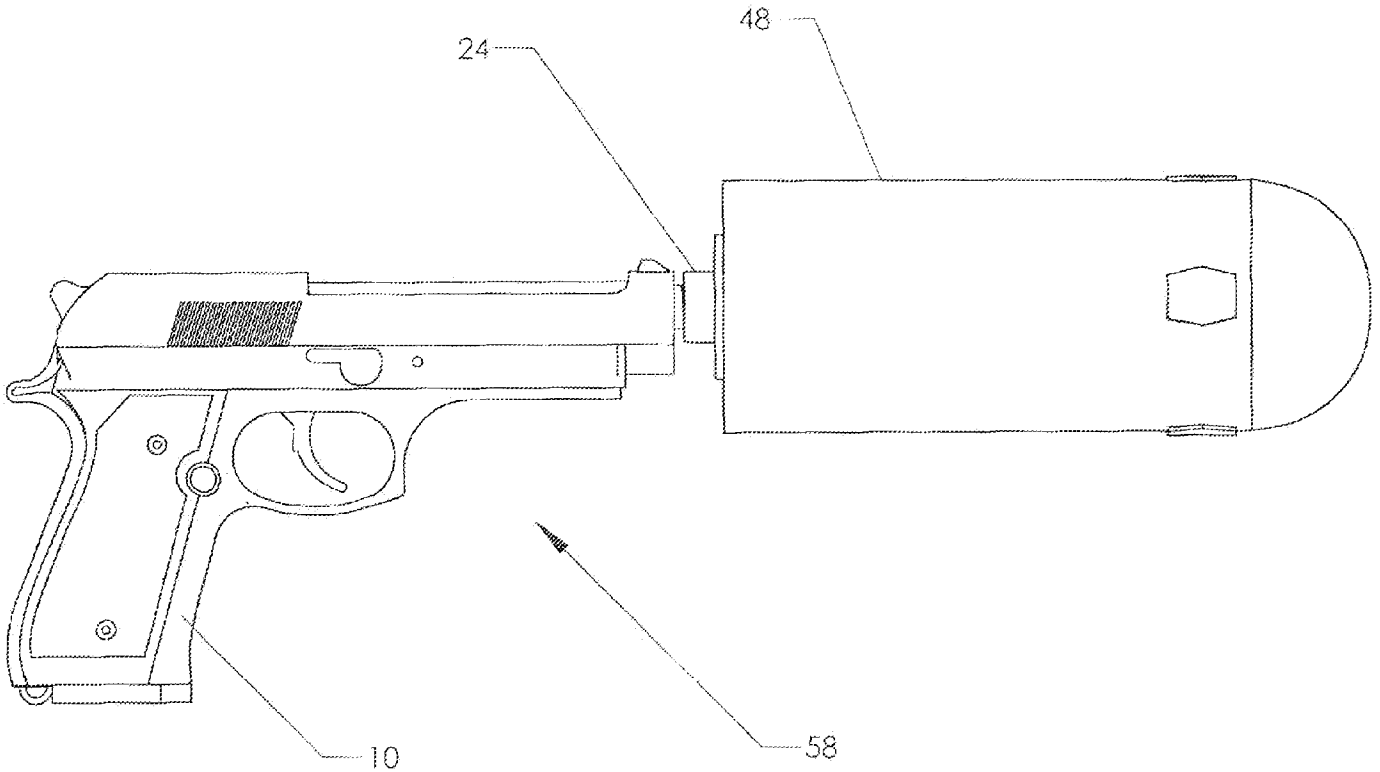
FIG. 7 is an elevation view, showing the projectile of FIG. 6 connected to the weapon of FIG. 5.

FIG. 7 shows projectile 48 slid over barrel adapter 24 on duplex weapon 58. As explained previously, the basic concept of the present invention is to provide a weapon capable of firing a high-mass/low-velocity projectile followed rapidly (if desired) by a conventional bullet. In the configuration of FIG. 7, the top cartridge in the magazine is preferably a "blank" cartridge (a cartridge that contains a primer and suitable propellant but no bullet). The other cartridges in the magazine are conventional.

If the user fires the weapon of FIG. 7, projectile 48 will be launched by the propellant gas from the blank cartridge. It will accelerate to the right (with respect to the vantage point of FIG. 7) and fly toward the target. The pistol slide, will cycle normally arid the next cartridge in the magazine will he hid into the firing chamber. The result will be tile eon figuration shown in FIG. 5. If the trigger is pulled again, a bullet will be fired down the firearm bore, through the bore in barrel adapter 24 and out toward the target.

Figure 9:
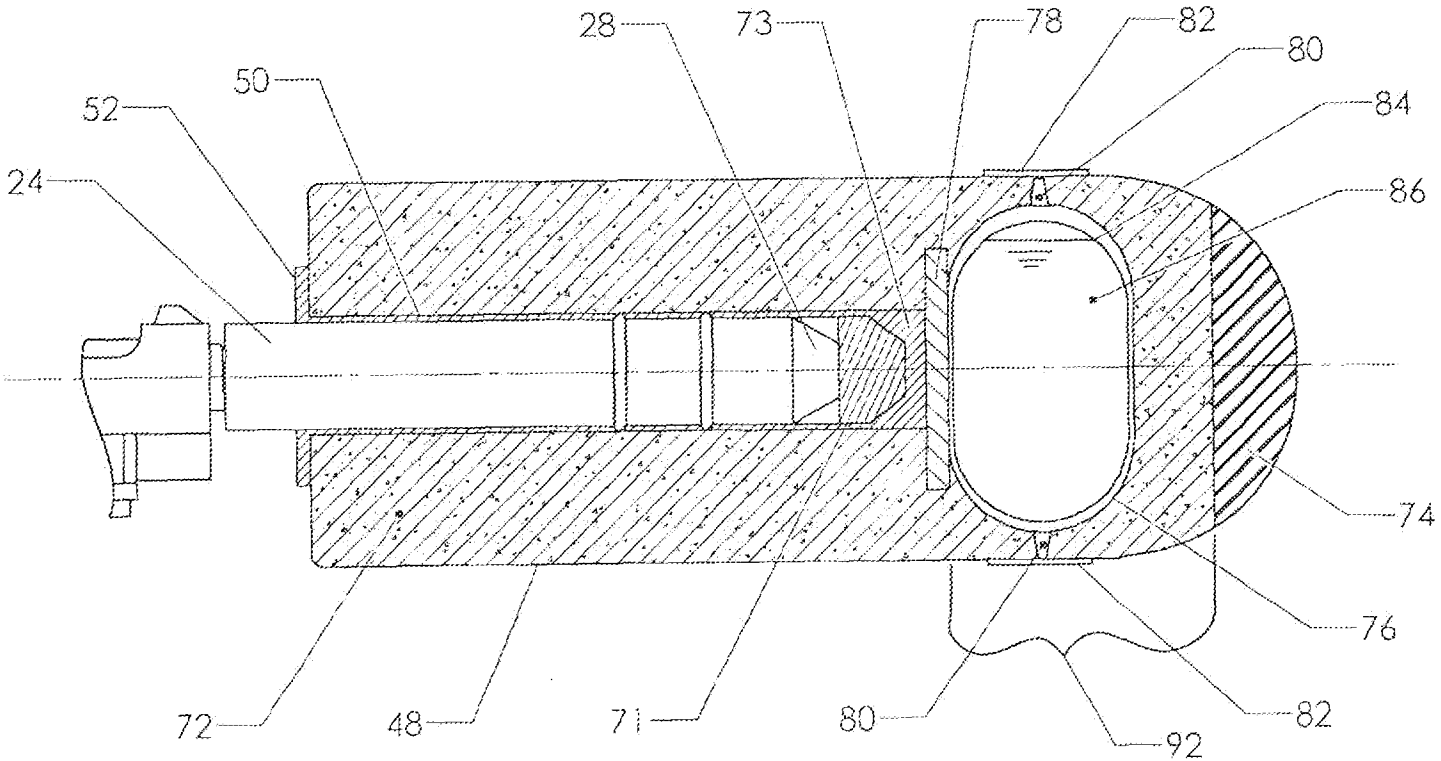
FIG. 9 is a sectional elevation view, showing internal details of a projectile used in the present invention.

The details of the firing process may be visualized with reference to FIGS. 4 and 9. In looking at the geometry of FIG 4, the reader will appreciate how the expanding propellant gases escaping from a blank cartridge will expand down firearm bore 40, adapter bore 42, and out exit 44. FIG. 9 shows a representative high-mass/low-velocity projectile 48 slidably mounted on barrel adapter 24. The expanding gas will fill the interior of launch tube 50, creating high pressure. This high pressure launches the projectile 48 off to the right. Returning briefly to FIG. 4, the reader will recall the presence of the two O-rings 32, 34. These provide a better seal between barrel adapter 24 and launch tube 50, thereby creating a "piston" effect that transfers greater energy to the projectile as it flies off the barrel adapter.

A pistol is illustrated as the firearm in the duplex weapon system of FIG. 7. Those skilled in the art will realize that many other types of firearm will also work, including rifles and shotguns. In addition, although a semi-automatic configuration is preferred, the invention can function using a revolver, a bolt action rifle, or a pump shotgun.

Figure 8:
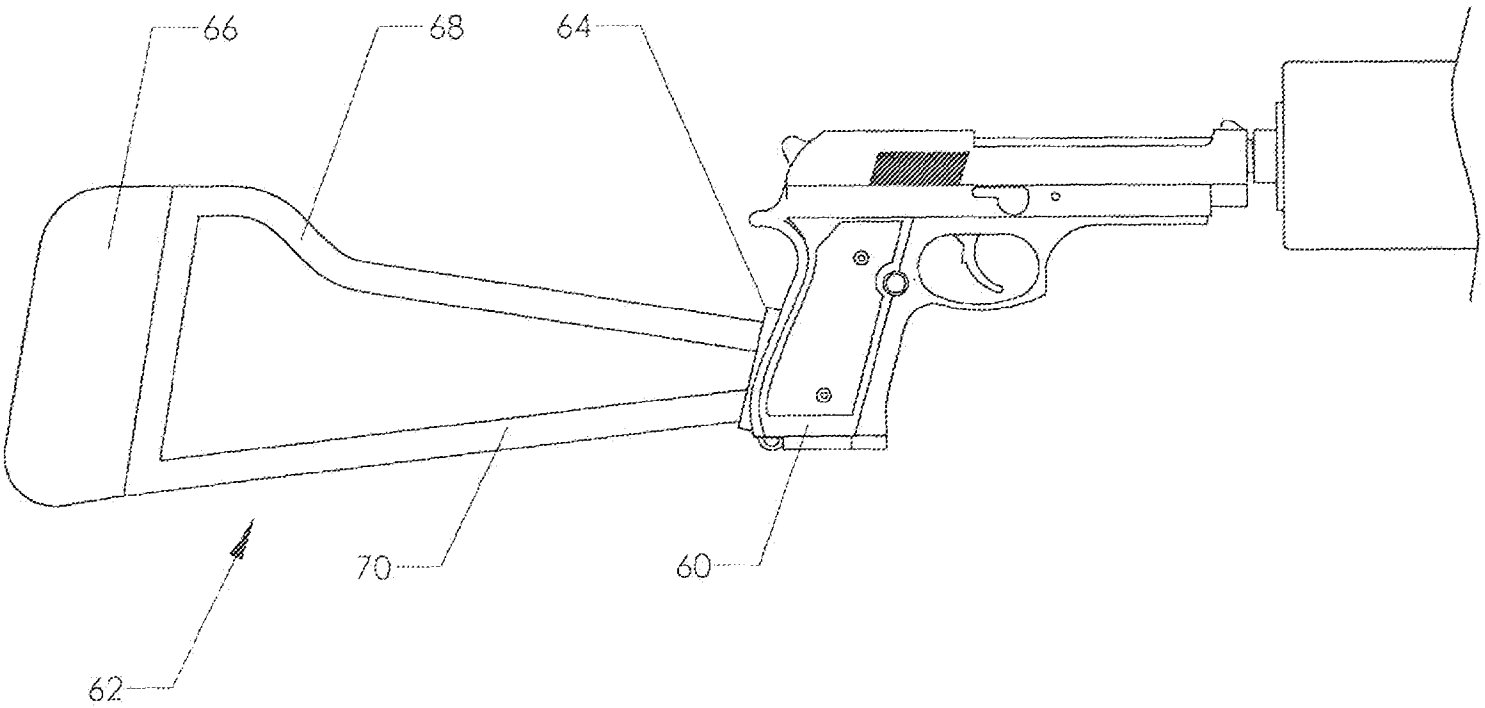
FIG. 8 is an elevation view, showing the user of an optional shoulder stock.

When fired from a pistol, the mass of projectile 48 may produce more recoil than some shooters can comfortably handle. FIG. 8 shows one solution to this concern. It has long been known to equip some pistols with a short shoulder stock. Such a shoulder stock is preferably detachable. Shoulder stock 62 connects to grip 60 via connector 64. Recoil pad 66 is linked to connector 64 by elastic beams 68, 70. The beams may be molded from fiber-reinforced polymer. Recoil pad 66 is preferably made of a soft, elastic material. The combination of these elements extends the time in which the recoil impulse is transferred to the user's shoulder and greatly reduces perceived recoil.

Figure 10:
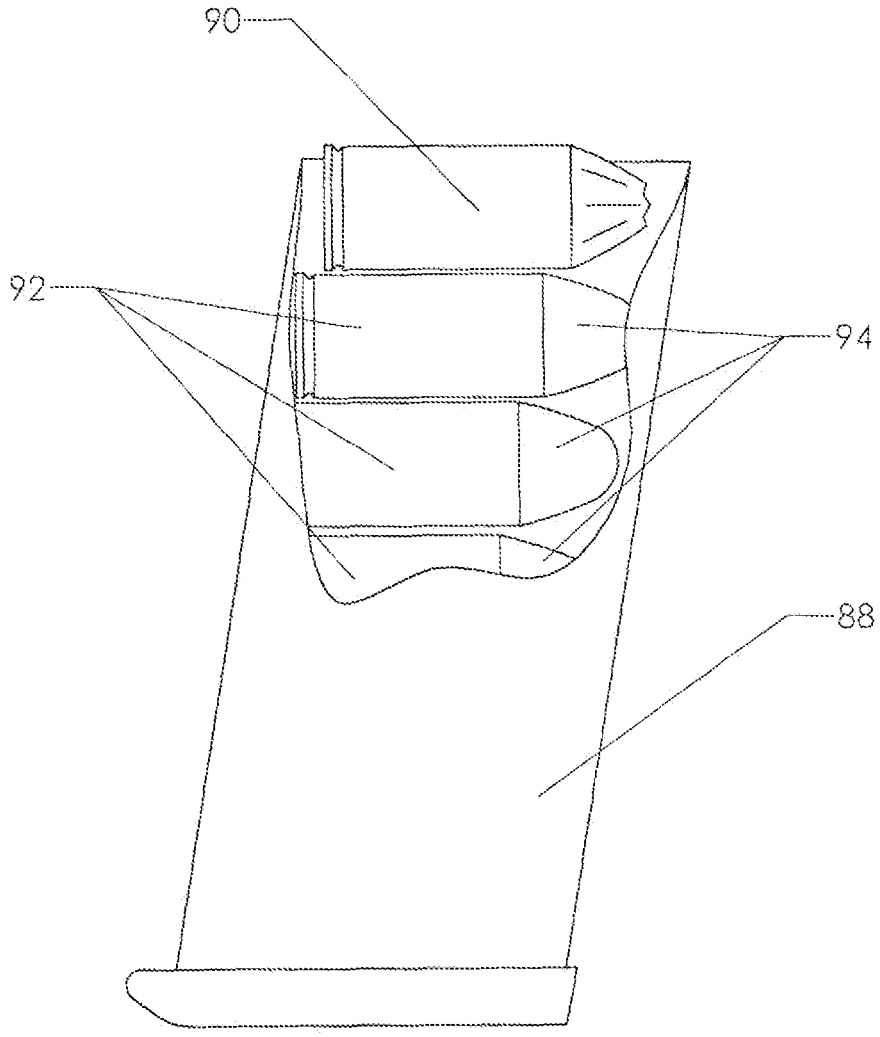
FIG. 10 is an elevation view with a cutaway, showing the cartridges used to fire the non-lethal and lethal projectiles used in the present invention.

FIG. 10 provides a representative view of a magazine used in a pistol that is part of the duplex weapon system. Magazine 88 contains a stack of cartridges. Blank cartridge 90 is preferably placed on top. A stack of conventional cartridges 92 then lies beneath the blank cartridge. The blank cartridge contains a primer and propellant. Rather than being sealed by a bullet however, the open mouth of the cartridge case is crimped over a sealing wad.

The firing and reloading mechanism of the firearm pushes the top cartridge forward and out of the magazine, in a manner that is well understood by those skilled in the art. A lift spring and follower contained in the magazine then urges the cartridge stack higher. Following the departure of blank cartridge 90 the uppermost conventional cartridge 92 will be fed into the firing chamber. The firearm then functions conventionally.

Figure 11:
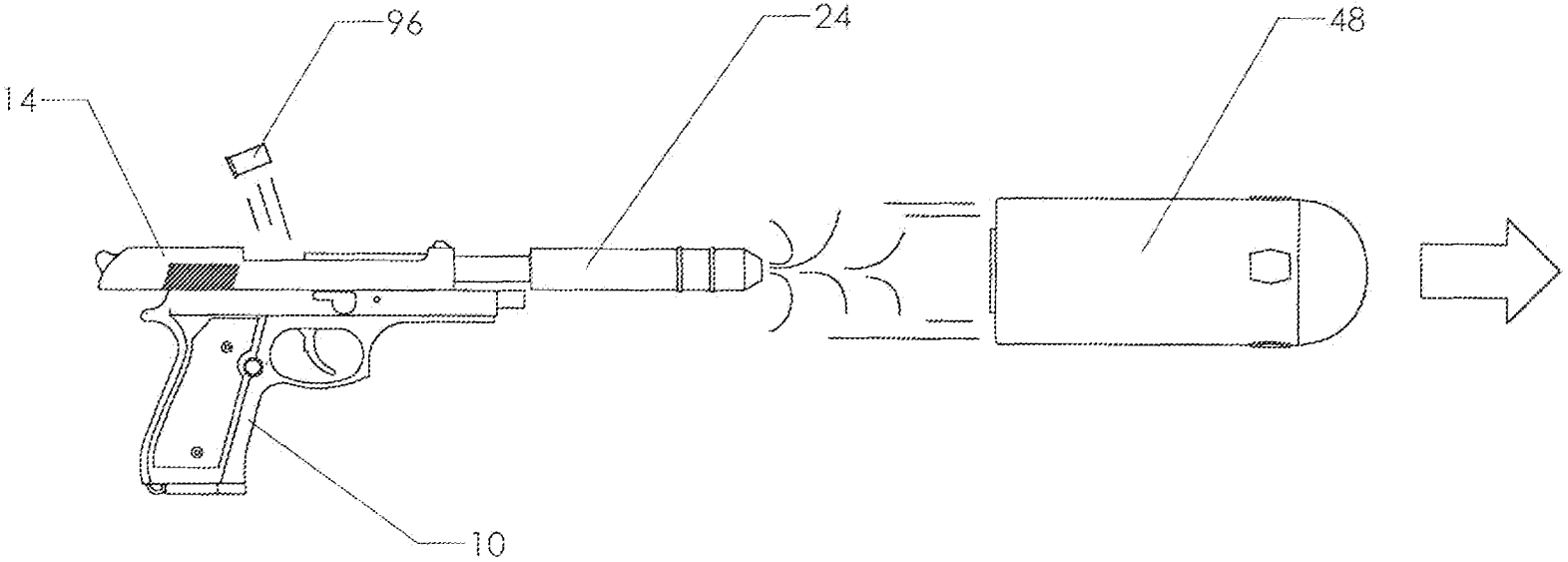
FIG. 11 is an elevation view, showing the firing of the present invention.

FIG. 11 actually shows the firing of the blank cartridge and he launching of projectile 48. In the case of the semi-automatic pistol shown, the firing of the blank cartridge also cycle slide 14 to the rear and ejects spent case 96.

Figure 12:
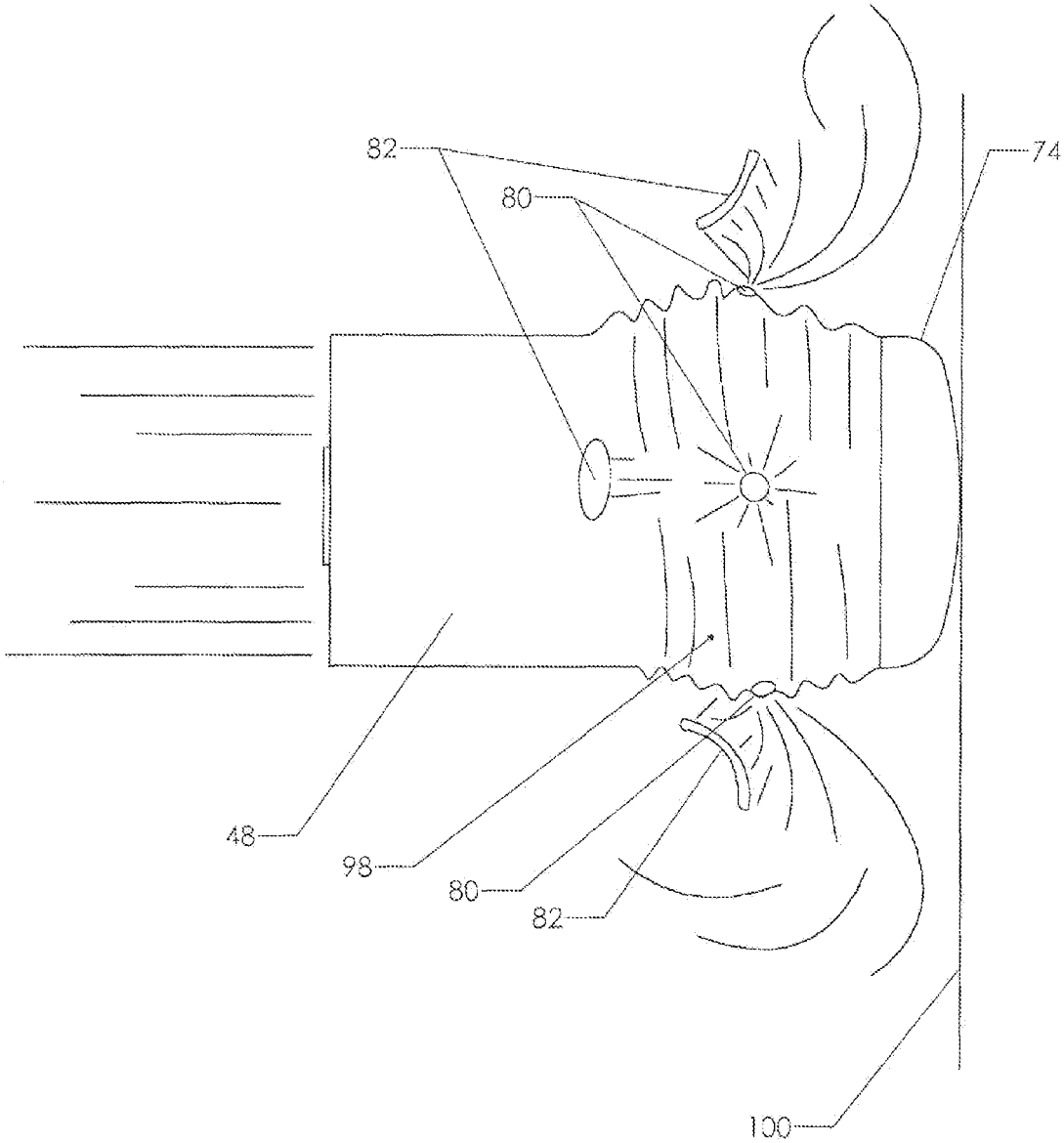
FIG. 12 is an elevation view, showing the projectile of the present invention striking a target.
Figure 13:
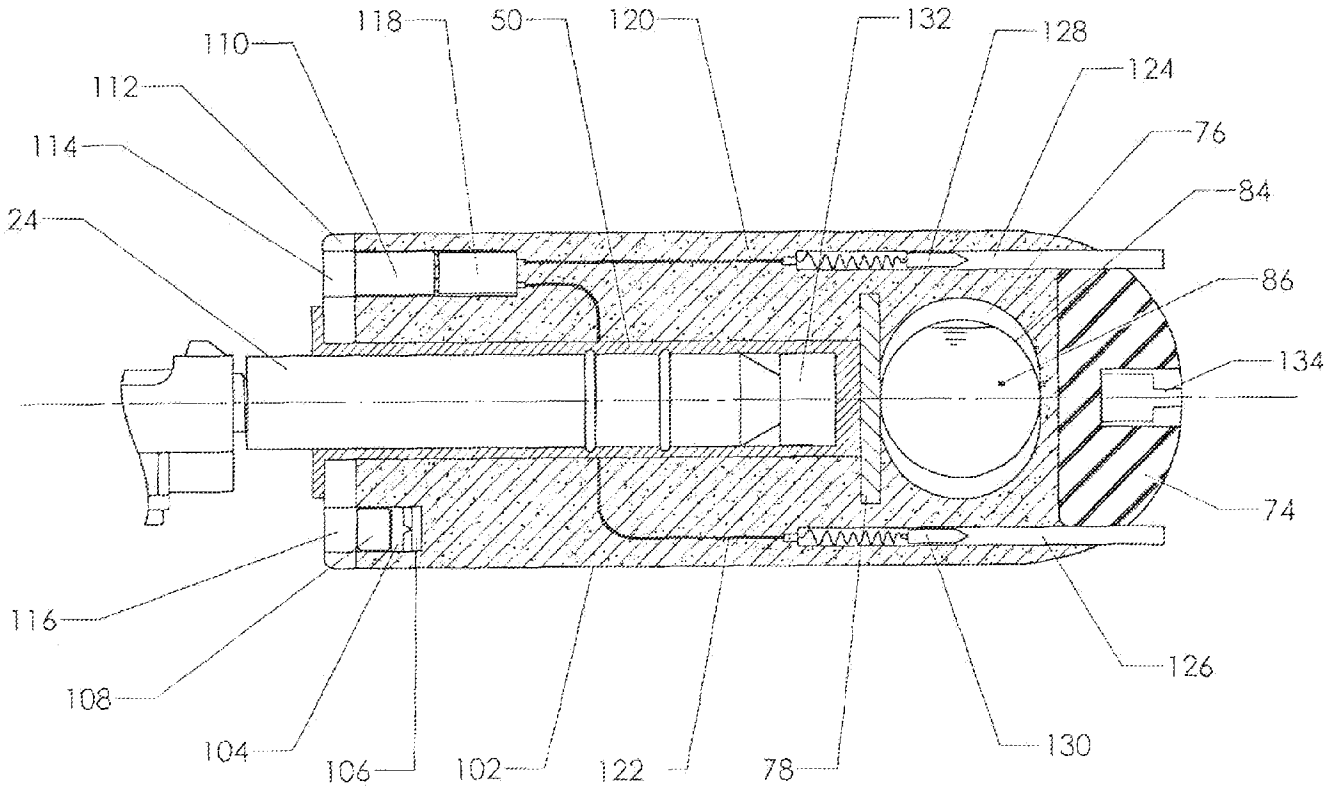
FIG. 13 is a sectional elevation view, showing internal details of another projectile used in the present invention.

FIGS. 9, 12, and 13 show internal details and operations of two embodiments of the high-mass/low-velocity ("HMLV") projectile. The projectile preferably includes features in addition to the impact delivered by its momentum. FIG. 9 shows an embodiment that delivers a chemical agent such as "pepper spray" (oleoresin capsicum, or "OC").

Projectile 48 includes body 72 and nose 74. The body is preferably made using a high density foam such as a polyurethane foam. Those skilled in the art will know that this type of material can be molded around other components in order to create a unified assembly. For example, launch tube 50 can be placed in the open mold and the polyurethane foam is then molded around it. If done properly, this creates a strong bond between the internal components and the body.

Nose 74 is preferably made of a hard rubber compound such as industrial urethane rubber. Of course, urethane rubber is a synthetic substance and is not natural rubber at all. Many different materials may be selected for the nose. However, it is preferably made harder than the balance of the body in order to deliver a sharper blow to the target. The rearward-facing surfaces of nose 74 may he provided with mechanical interlocking features so that it can be strongly attached to the polyurethane foam of body 72. An example of a mechanical interlocking feature is a barbed protrusion.

As explained previously, launch tube 50 includes a cylindrical inward facing surface configured to slide over the exterior surface of barrel adapter 24. The rearward extreme of the launch tube is open. The forward extreme is preferably closed, such as by bulkhead 73. A compressible bullet trap 71 is preferably provided in the vicinity of the forward portion of the launch tube, including actually inside the launch tube as shown.

The inclusion of the bullet trap is preferred, since it is always possible that a user will fire a conventional cartridge (including a bullet) while projectile 48 is mounted on barrel adapter 24. In that case the bullet would exit the barrel adapter and embed itself in the bullet trap. The transfer of the bullet's momentum would then launch projectile 48.

Some of the embodiments of projectile 48 arc designed to be reusable and some are not. For the re-usable versions, the bullet trap will likely only be effective once. Thus, if it has received a bullet it is preferable to somehow indicate that fact. One approach is to embed a dye pack that ruptures when struck by a bullet. The dye pack will color the rear portion of the launch tube interior and will be apparent to the user.

For the versions that are not reusable, the use of a suitable bullet trap can eliminate the need to use a blank cartridge to fire the weapon. An actual bullet can be used as the firing mechanism. This greatly simplifies operation for the officer since he or she only needs to carry one type of ammunition.

The projectile embodiment shown in FIG. 9 is not intended to be reusable. It is designed to strike a target and simultaneously deliver a chemical agent such as OC. Chemical agent 86 is contained within frangible bag 84 in cavity 76. In this context the term "frangible" means any closed bag that can be opened via the impact of the projectile against a target.

One or more ports 80 may be provided to connect cavity 76 with the exterior of projectile 48. The outside of these ports may be covered by a port cover 82, or they may simply be left open. The reader will observe that cavity 76 is positioned between backing plate 78 and the rear of nose 74. Backing plate 78 is preferably a metal disk that is located, directly in front of launch tube 50. The rear of nose 74 provides the other boundary. Thus, cavity 76 is positioned within crush zone 98.

When the projectile strikes a target, the mass of the components lying behind the crush zone propels these components forward against frangible bag 84. The frangible bag is then propelled against the relatively firm rearward-facing surface of nose 74. Frangible bag 84 ruptures and its contents are forcibly expelled through the port(s). If port covers are used, these are blown clear by the escaping chemical agent.

FIG. 12 graphically depicts this process. Projectile 48 is flying forward at considerable velocity when it strikes target surface 100. The collapse of crush zone 98 ruptures the frangible bag and the escaping bag contents blow port covers 82 clear. The chemical agent is violently dispersed around the area of the target.

The inclusion of a chemical agent allows the officer another option. If a subject is not particularly dangerous but needs to he driven out of an area, the officer can aim the HMLV projectile of FIG. 9 at a wall surface near the subject. The projectile of FIG. 9 will then reliably disperse a chemical agent in the subject's vicinity.

If, on the other hand, the subject is advancing on the officer, the officer can aim the HMLV projectile at the subject's chest and gain the dual benefit of (1) knocking clown the subject: and (2) likely incapacitating the subject with the chemical agent.

An HMLV projectile made according to the present invention can also be used to deliver a wide range of other payloads. FIG. 1 illustrates an embodiment including two other payloads. Projectile 102 is similar to projectile 48, but has several significant additional features. Base 112 is provided. This is preferably a piece of strong molded plastic. It includes hatch 114, through which battery 110 and stun controller 118 are accessed. The stun controller is part of an electroshock weapon. It provides high-voltage electrical current through positive lead 120 and negative lead 122. Positive lead 120 is connected to positive dart 128 and negative lead 122 is connected to negative dart 130.

The two darts are slidably housed within launch tubes 124, 126. The two launch tubes are preferably located outside the perimeter of nose 74—which has a modified shape in this embodiment. When the projectile strikes a target, the two launch tubes are stopped by the target and momentum propels the positive and negative darts forward and into the subject. At the same time, a deceleration detector within stun controller 118 detects the impact and starts sending pulsed voltage to the positive and negative darts.

In most instances, projectile 102 will rebound away from the target but the darts will remain embedded in the target. Thus, a coil of conductor connects each dart back to the stun controller. This allows the stun controller to continue administering the electroshock for a suitable period.

Cover 116 provides an exit for flash/bang cartridge 108. When the projectile decelerates upon impact, striker 104 fires ejector cartridge 106 and blows the flash/hang cartridge free. The cartridge then detonates, created a bright flash and a loud bang. An integrated or separate smoke cartridge could also be provided.

In the embodiment of FIG. 13, launching charge 132 may be placed in the forward portion of the launch tube. This charge is ignited by the expanding propellant gases. It produces additional expanding gases, with this supplemental production preferably continuing even while the projectile is in flight. The effect is that of a rocket motor. Launching charge 132 is thereby capable of increasing the effective range of the HMLV projectile.

It is preferable to provide a relatively large diameter for the HMLV projectile, with the preferred embodiments having a diameter of 2 to 5 inches. This allows the impact forces to be spread over a greater surface area on the subject's body and thereby reduces the chance of a serious injury. This enlarged diameter is not without its disadvantages, however. In looking at FIG. 7, those skilled in the art will realize that the projectile body is so large it may interfere with some of the firearm's sighting system. It obscures the open sights on top of the pistol and may also obscure a laser sighting device (which is typically hung on the bottom of the frame).

In order to solve this concern, a separate laser sight may be provided in the projectile itself. FIG. 13 shows the inclusion of laser sight 134 in nose 74. The officer can activate this sighting device and then use the impact point of the laser to aim and fire the projectile. Of course, once the HMLV projectile is fired, the conventional sights on the firearm may again be used, FIG. 13 also presents the basis for an optional embodiment in which projectile 102 is launched without using a firearm. In this scenario, launching charge 132 would include enough propellant to carry projectile 102 to the intended target. A "blank" cartridge in a conventional firearm would not be needed. Rather, the user would only need to ignite the launching charge.

A solid barrel adapter 24 could be provided as a launching device. The leading end of the barrel adapter could then be provided with a pair of electrodes that come in contact with launching charge 132 when projectile 102 is placed or the barrel adapter. The barrel adapter in this version would not need to he connected to a firearm. In fact, the barrel adapter itself could include suitable gripping features (such as a hand grip and a butt stock) that would make it easy to hold.

The barrel adapter would include a battery and a switching circuit. The switching circuit would be used to energize the electrodes in contact with the launching charge—thereby firing the projectile. Of course, a conventional percussive detonator could also be used to fire the launching charge.

The illustrations of the invention have included the use of a firearm. While the ability to use the invention as part of an operating, firearm is an advantage, the invention is by no means limited to use with firearms. Many other methods of launching the HMLV projectile are possible. FIG. 13 provides one example. The projectile embodiment shown may be propelled forward solely by the detonation of launching charge 132. In his context barrel adapter 24 may be a solid object that is not attached to a conventional firearm. It is preferable to provide gripping devices attached to the barrel adapter such as a stock and a hand grip—but there does not need to be any sort of firearm involved.

The barrel adapter could include an electrical firing device for igniting launching charge 132. The launching charge could also include an embedded percussive cap. A striker extending from the end of the barrel adapter could strike this percussive cap in order to mechanically detonate the launching charge and thereby launch the projectile.

A compressed gas could also be used to launch the HMLV projectile. Compressed gas technology is often used to launch projectiles from paint ball guns. In such an embodiment compressed gas could be selectively fed through a bore in the middle of barrel adapter 24. The expanding gas would then propel the projectile away from the barrel adapter. Again, there would be no need to involve a conventional firearm. The launcher would be a triggering device accepting compressed gas, preferably in the form of a replaceable cylinder.

Although the preceding description contains significant detail, it should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

The invention claimed is:

1. A method for firing a high-mass/low-velocity projectile followed by a bullet, comprising:

a. providing a firearm, including,
   i. a barrel having a firearm bore and a muzzle,
   ii. a first cartridge,
   iii. a second cartridge having a bullet;
b. providing a barrel adapter, including,
   i. an external surface,
   ii. an adapter bore,
   iii. an exit;
attaching said barrel adapter to said muzzle of said barrel, with said adapter bore being aligned with said firearm bore;
providing a high-mass/low-velocity projectile, including,
   i. a launch tube having an internal surface configured to slide over said external surface on said barrel adapter,
   ii. a body surrounding at least a portion of said launch tube,
   iii. a nose,
   iv. wherein a mass of said high-mass/low-velocity projectile is greater than 0.2 pounds,
   v. a stun controller,
   vi. a positive dart electrically connected to said stun controller,
   vii. a negative dart electrically connected to said stun controller,
   viii. a first launch tube containing said positive dart,
   ix. a second launch tube containing said negative dart;
e. sliding said internal surface of said launch tube over said external surface of said barrel adapter in order to slidably connect said high-mass/low-velocity projectile to said barrel adapter;
f. placing said first cartridge in said barrel;
g. firing said first cartridge, thereby sending expanding propellant gas down said firearm bore and said adapter bore, said propellant gas escaping said exit in said barrel adapter and propelling said high-mass/low-velocity projectile away from said barrel adapter;
h. placing said second cartridge in said barrel; and
i. firing said second cartridge, thereby sending said bullet down said firearm bore, through said adapter bore and out said exit in said barrel adapter.

2. A method for firing a high-mass/low-velocity projectile followed by a bullet, comprising:

a. providing a firearm, including,
   i. a barrel having a firearm bore and a muzzle.
   ii. a first cartridge,
   iii. a second cartridge haying a bullet;
b. providing a barrel adapter, including,
   i. an external surface,
   ii. an adapter bore,
   iii. an exit;
c. attaching said barrel adapter to said muzzle of said barrel, with said adapter bore being aligned with said firearm bore;
d. providing a high-mass/low-velocity projectile, including,
   i. a launch tube having an internal surface configured to slide over said external surface on said barrel adapter,
   ii. a body surrounding at least a portion of said launch tube,
   iii. a nose,
   iv. wherein a mass of said high-mass/flow-velocity projectile is greater than 0.2 pounds;
e. sliding said internal surface of said launch tube over said external surface of said barrel adapter in order to slidably connect said high-mass/low-velocity projectile to said barrel adapter;
f. placing said first cartridge in said barrel;
g. firing said first cartridge, thereby sending expanding propellant gas down said firearm bore and said adapter bore, said propellant gas escaping said exit in said barrel adapter and propelling said high-mass/low-velocity projectile away from said barrel adapter;
h. placing said second cartridge in said barrel; and i. firing said second cartridge, thereby sending said bullet down said firearm bore, through said adapter bore and out said exit in said barrel adapter;

j. wherein said high-mass/flow-velocity projectile further comprises a laser sight capable of projecting a laser beam that is parallel with said adapter bore.

3. A method for firing a high-mass/low-velocity projectile followed by a bullet, comprising:

a. a providing a firearm, including, i. a barrel having a firearm bore and a muzzle, ii. a first cartridge, iii. a second cartridge having a bullet;

b. providing a barrel adapter, including, i. an external surface, ii. an adapter bore, iii. an exit;

c. attaching said barrel adapter to said muzzle of said barrel, with said adapter bore being aligned with said firearm bore;

d. providing a high-mass/low-velocity projectile, including, i. a launch tube having an internal surface configured to slide over said external surface on said barrel adapter, ii. a body surrounding at least a portion of said launch tube, iii. a nose, iv. wherein a mass of said high-mass/low-velocity projectile is greater than 0.2 pounds;

e. sliding said internal surface of said launch tube over said external surface of said barrel adapter in order to slidably connect said high-mass/low-velocity projectile to said barrel adapter;

f. placing said first cartridge in said barrel;

g. firing said first cartridge, thereby sending expanding propellant gas down said firearm bore and said adapter bore, said propellant gas escaping said exit in said barrel adapter and propelling said high-mass/low-velocity projectile away from said barrel adapter;

h. placing said second cartridge in said barrel; and i. firing said second cartridge, thereby sending said bullet down said firearm bore, through said adapter adapter bore and out said exit in said barrel adapter;

j. wherein said launch tube includes a launching charge that is ignited by said expanding propellant gases, said launching charge producing additional expanding propellant gases that push said high-mass/low-velocity projectile along its flight path.

4. A method for firing a high-mass/low-velocity projectile followed by a bullet, comprising;

a. providing a firearm, including, i. a barrel having firearm bore and a muzzle;

ii. a first cartridge, iii. a second cartridge having a bullet;

b. providing a barrel adapter, including, i. an external surface, ii. an adapter bore, iii. an exit;

c. attaching said barrel adapter to said muzzle of said barrel, with said adapter bore being aligned with said firearm bore;

d. providing a high-mass/low-velocity projectile, including, i. a launch tube having an internal surface configured to slide over said external surface on said barrel adapter, ii. a body surrounding at least a portion of said launch tube, iii. a nose, iv. wherein a mass of said high-mass/low-velocity projectile is greater than 0.2 pounds;

v. a stun controller, vi. a positive dart electrically connected to said stun controller, vii. a negative dart electrically connected to said stun controller, viii. a first launch tube containing said positive dart, ix. a second launch tube containing said negative dart;

e. sliding said internal surface of said launch tube over said external surface of said barrel adapter in order to slidably connect said high-mass/flow-velocity projectile to said barrel adapter;

f. placing said first cartridge in said barrel;

a. firing said first cartridge, thereby sending expanding propellant gas down said firearm bore and said adapter bore, said propellant gas escaping said exit in said barrel adapter and propelling said high-mass/flow-velocity projectile away from said barrel adapter at a velocity between 30 feet per second and 120 feet per second;

h. placing said second cartridge in said barrel; and i. firing said second cartridge, thereby sending said bullet down said firearm bore, through said adapter bore and out said exit in said barrel adapter.

5. A method for firing a high-mass/low-velocity projectile followed by a bullet, comprising:

a. providing a firearm, including, i. a barrel having a firearm bore and a muzzle, ii. a first cartridge, iii. a second cartridge having a bullet;

b. providing a barrel adapter, including, i. an external surface, ii. an adapter bore, iii. an exit;

c. attaching said barrel adapter to said muzzle of said barrel, with said adapter bore being aligned with said firearm bore;

d. providing a high-mass/low-velocity projectile, including, i. a launch tube having an internal surface configured to slide over said external surface on said barrel adapter, ii. a body surrounding at least a portion of said launch tube, iii. a nose, iv. wherein a mass of said high-mass/low-velocity projectile is greater than 0.2 pounds v. a laser sight capable of projecting a laser beam that is parallel with said adapter bore;

e. sliding said internal surface of said launch tube over said external surface of said barrel adapter in order to slidably connect said high-mass/low-velocity projectile to said barrel adapter;

f. placing said first cartridge in said barrel;

g. firing said first cartridge, thereby sending propellant gas down said firearm bore and said adapter bore, said propellant gas escaping said exit in said barrel adapter and propelling said high-mass/low-velocity projectile away from said barrel adapter at a velocity between 30 feet per second and 120 feet per second;

h. placing said second cartridge in said barrel; and i. firing said second cartridge, thereby sending said bullet down said firearm bore, through said adapter bore and out said exit in said barrel adapter.

6. A method for firing a high-mass/low-velocity projectile followed by a bullet, comprising:

a. providing a firearm, including, i. a barrel having a firearm bore and a muzzle, ii. a first cartridge,
iii. a second cartridge having a bullet;
b. providing a barrel adapter, including,
i. an external surface,
ii. an adapter bore,
iii. an exit;
c. attaching said barrel adapter to said muzzle of said barrel, with said adapter bore being aligned with said firearm bore;
d. providing a high-mass/low-velocity projectile, including,
i. a launch tube having an internal surface configured to slide over said external surface on said barrel adapter.
ii. a body surrounding at least a portion of said launch tube,
iii. a nose,
iv. wherein a mass of said high-mass/low-velocity projectile greater than 0.2 pounds,
v. wherein said launch tube includes a launching charge that is ignited by said expanding propellant gases, said launching charge producing additional expanding propellant gases that push said high-mass/low-velocity projectile along its flight path;
e. sliding said internal surface of said launch tube over said external surface of said barrel adapter in order to slidably connect said high-mass/low-velocity projectile to said barrel adapter;
f. placing said first cartridge in said barrel;
g. firing said first cartridge, thereby sending expanding propellant gas down said firearm bore and said adapter bore, said propellant gas escaping said exit in said barrel adapter and propelling said high-mass/low-velocity projectile away from said barrel adapter at a velocity between 30 feet per second and 120 feet per second;
h. placing said second cartridge in said barrel; and
i. firing said second cartridge, thereby sending said bullet down said firearm bore, through said adapter bore and out said exit in said barrel adapter.

7. The method for firing a high-mass/flow-velocity projectile followed by a bullet as recited in claim 1, wherein said high-mass/low-velocity projectile further comprises:
a. an exterior
b. an internal cavity connected to said exterior by at east one port;
c. a chemical agent contained in said internal cavity; and
d. a frangible barrier between said chemical agent and said port, said frangible barrier configured to rupture when said high-mass/low-velocity projectile strikes a target.

8. The method for firing a high-mass/low-velocity projectile followed by a bullet as recited in claim 2, wherein said high-mass/low-velocity projectile further comprises:
a. an exterior;
b. an internal cavity connected to said exterior by at least one port;
c. a chemical agent contained in said internal cavity; and
d. a frangible barrier between said chemical agent and said port, said frangible barrier configured to rupture said high-mass/low-mass projectile strikes a target.

9. The method for firing a high-mass/flow-velocity projectile followed by a bullet as recited in claim 3, wherein said high-mass/flow-velocity projectile further comprises:
a. an exterior;
b. an internal cavity connected to said exterior by at least one port;
c. a chemical agent contained in said internal cavity; and
d. a frangible barrier between said chemical agent and said port, said frangible barrier configured to rupture when said high-mass/low-velocity projectile strikes a target.

10. The method for firing high-mass/low-velocity projectile followed by a bullet as recited in claim 4, wherein said high-mass/low-velocity projectile further comprises:
a. an exterior;
b. an internal cavity connected to said exterior by at least one port;
c. a chemical agent contained in said internal cavity; and
d. a frangible barrier between said chemical agent and said port, said frangible barrier configured to rupture when said high-mass/velocity projectile strikes a target.

11. The method for firing a high-mass/low-velocity projectile followed by a bullet as recited in claim 5, wherein said high-mass/low-velocity projectile further comprises:
a. an exterior;
b. an internal cavity connected to said exterior by at least one port;
c. a chemical agent contained in said internal cavity; and
d. a frangible barrier between said chemical agent and said port, said frangible barrier configured to rupture when said high-mass/low-velocity projectile strikes a target.

12. The method for firing a high-mass/low-velocity projectile followed by a bullet as recited in claim 6, wherein said high-mass/low-velocity projectile further comprises:
a. an exterior;
b. an internal cavity connected to said exterior by at least one port;
c. a chemical agent contained in said internal cavity; and
d. a frangible barrier between said chemical agent and said port, said frangible barrier configured to rupture when said high-mass/low-velocity projectile strikes a target.

13. The method for firing a high-mass/low-velocity projectile followed by a bullet as recited in claim 2, wherein said projectile further comprises:
a. a stun controller;
b. a positive dart electrically connected to said stun controller; and
c. a negative dart electrically connected to said stun controller.

14. The method for firing a high-mass/low-velocity projectile followed by a bullet as recited in claim 3, wherein said projectile further comprises:
a. a stun controller;
b. a positive dart electrically connected to said stun controller; and
c. a negative dart electrically connected to said stun controller.

15. The method for firing a high-mass/low-velocity projectile followed by a bullet as recited in claim 5, wherein said projectile further comprises:
a. a stun controller;
b. a positive dart electrically connected to said stun controller; and
c. a negative dart electrically connected to said stun controller.

16. The method for firing a high-mass/low-velocity projectile followed by a bullet as recited in claim 6, wherein said projectile further comprises:
a. a stun controller;
b. a positive dart electrically connected to said stun controller; and
c. a negative dart electrically connected to said stun controller.

* * * * *